US006883669B2

(12) United States Patent
Olson et al.

(10) Patent No.: US 6,883,669 B2
(45) Date of Patent: Apr. 26, 2005

(54) MULTI-ELEMENT AIRFOIL FOR PULP SCREENS

(75) Inventors: James A. Olson, Delta (CA); Jordan Ko, Richmond (CA)

(73) Assignee: The University of British Columbia, Vancouver (CA)

( * ) Notice: Subject to any disclaimer, the term of this patent is extended or adjusted under 35 U.S.C. 154(b) by 184 days.

(21) Appl. No.: 10/313,027

(22) Filed: Dec. 6, 2002

(65) Prior Publication Data

US 2004/0108254 A1 Jun. 10, 2004

(51) Int. Cl.[7] ..... B07B 1/20

(52) U.S. Cl. ..... 209/305; 209/306; 209/393; 209/273; 162/251; 162/55

(58) Field of Search ..... 209/306, 305, 209/300, 273, 393; 162/251, 55

(56) References Cited

U.S. PATENT DOCUMENTS 4,919,797 A * 4/1990 Chupka et al. ..... 209/273
5,799,798 A 9/1998 Chen et al.

FOREIGN PATENT DOCUMENTS

| | | |
|---|---|---|
| EP | 0 9500 754 A1 | 10/1999 |
| JP | 63 243392 | 10/1988 |
| WO | WO 90/05807 | 5/1990 |
| WO | WO 93/22/494 | 11/1993 |
| WO | WO 94/25183 | 11/1994 |

* cited by examiner

*Primary Examiner*—Donald P. Walsh
*Assistant Examiner*—Kaitlin Joerger
(74) *Attorney, Agent, or Firm*—C. A. Rowley

(57) ABSTRACT

A the operation of pulp screening apparatus may be improved by employing a multi element foil having a leading foil section and a trailing foil section spaced from and trailing leading section so that adjacent surfaces of the sections one formed by a portion of a pressure side of the leading section and the other by the leading end of the trailing foil section define opposed walls of a passage for fluid directing fluid flow from the pressure side of the leading foil section to a cambered low pressure side of the trailing section. The angle of attack ($\alpha$) of the complete multi element foil is set to be significantly less than the angle of attack ($\theta$) of the trailing foil section to increase the negative pressure pulse generated by the trailing section and thereby improve operation of the screening device.

20 Claims, 3 Drawing Sheets

MULTI-ELEMENT AIRFOIL FOR PULP SCREENS

FIELD OF INVENTION

The present invention relates to an improved screening apparatus more particularly the present invention relates an improved pulp (as used in the paper industry) employing a hydrofoil to pump pulp through the screen and to clean the screen.

BACKGROUND OF THE PRESENT INVENTION

The use of rotors with foils for cleaning pulp screens by generating pressure pulses as the foil is moved past the screen is a well-known and common technique that has been practiced in the industry for many years. The pressure pulse, specifically the negative pulse, clears the apertures by causing a flow reversal that backflushes the fibres in the apertures. This cleaning technique is reasonably effective, but the maximum negative pressure pulses that conventional foils or rotors can generate effectively are limited. Some specific examples of those found in the art are described below.

PCT application—PCT/SE89/00568 WO 90/05807 published May 31, 1990 inventor Lundberg et al. discloses a typical screening apparatus and teaches the use of wing elements on the rotor (as opposed to foils) constructed so that the leading end of the wing in the direction of rotation is spaced closer to the screen than the trailing end and the wing has a dimension measured in the direction of movement (circumferential direction) that is at least twice the radial dimension of the screen to generate a suction force to draw liquid that has already passed through the screed to the outlet side back through the screen to the inlet side to dilute the pulp on the inlet side and to clean the pores of the screen.

PCT application no PCT/FI/00151—WO 93/22494 published Nov. 11, 1993 to Alajaaski et al. describes a special pulse generator that tends to locally confine the pulse to thereby improve the cleaning operation of the pulse generator which in turn increases screening efficiency PCT application PCT/US94/04582—WO 94/25183 published Nov. 10, 1994 inventor Egan et al. describes the use of a special adjustable hydrofoil having a moveable section projecting out from it's cambered surface. The position of this moveable section is adjusted to obtain the optimum spacing between the screen and rotor to thereby improve the operation of the screening device.

EP 0950 754 A1 published Oct. 20, 1998 by Alkawa describes a stirring device in the form of a foil that applies fluid pressure against the screen adjacent to the leading end of the foil and a negative pressure for cleaning the screen adjacent to the trailing end of the foil.

U.S. Pat. No. 5,799,798 issued Sep. 1, 1998 to Chen teaches the use of conventional stirrers or foil and uses specially designed screen bars to improve the operation of the screening system.

Japanese patent 93-243392 shows the use of angular bars on the low-pressure side of the screen to improve the operation of the screening device.

In the aircraft industry higher angle of attacks are achieved without separation of the air passing along the foil from the camber surface of the foil by employing cambered airfoils with multi-element configurations. This results in being able to attain higher lift forces by using multi-element airfoils which in effect delay the onset of flow separation from the foil (stall) and allow higher angles of attack and increased camber. The stall condition is delayed by allowing air from the high-pressure side of the wing or foil to pass into the boundary layer of the low-pressure side of the wing. This injection of air re-energizes the boundary layer enabling the flow to remain attached to the foil. Multi-element airfoils are commonly used in aerodynamic applications.

BRIEF DESCRIPTION OF THE PRESENT INVENTION

It is an object of the present invention to provide an improved foil for improving the effectiveness of the screening process.

Broadly the present invention relates to a pulp screening apparatus comprising a substantially cylindrical screen having a cylindrical axis, a foil, means for mounting said foil for rotation on said cylindrical axis, said foil having a leading foil section and a trailing foil section, said leading foil section leading in a direction of movement of said foil as it is rotated around said cylindrical axis and said trailing section spaced from and trailing said leading section in said direction of movement to provide a space separating said a trailing end of said leading foil section and a leading end of said trailing foil section and defining a passage for fluid, each of said foil sections having a high pressure side facing away from said screen and a cambered low pressure side facing and positioned adjacent to said screen, said trailing end of said leading foil section having a portion adjacent to which said leading end of said trailing foil section is positioned so that a surface of said portion of said pressure face on said leading foil section and an adjacent surface of said leading end of said trailing foil section define opposite walls of said passage, said high pressure side of said leading foil section, said opposite walls of said passage and said cambered low pressure side of said trailing foil section being relatively positioned so that fluid passing across said high pressure side of said leading foil section passes through said passage and along said cambered low pressure side of said trailing section, said foil being set at a first angle of attack ($\alpha$) and said trailing foil section being set a second angle of attack ($\theta$).

Preferably said first ($\alpha$) and second ($\theta$) angles of attack are different.

Preferably said second angle of attack ($\theta$) is larger than said first angle of attack ($\alpha$).

Preferably said first angle of attack ($\alpha$) will be in the range of 0 to 30°, more preferably 5 to 15°, and said second angle of attack ($\theta$) will be in the range of 0 to 60°, more preferably 5 to 15°.

Preferably, said passage has a substantially uniform width measured parallel to said axis said width tapering from its mouth at the intersection of high pressure surface of said leading foil section with said cavity and minimum width (w) between opposite surfaces.

Preferably said minimum dimension (w) measured will be in the range of 0.1 to 5 centimeters (cm.), more preferably in the range of 0.5 to 2 centimeters.

Preferably said leading foil section has a first length (x+y) measured along its cambered surface and said trailing foil section has a second length (z) measured along its cambered surface and the ratio of said first length to said second length will be in the range of 1 to 2 and 1 to 0.1, more preferably 1 to 1 and 1 to 0.25.

Preferably said portion comprise a nesting cavity formed in said leading foil and said leading end of said trailing foil is received in said nesting cavity.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
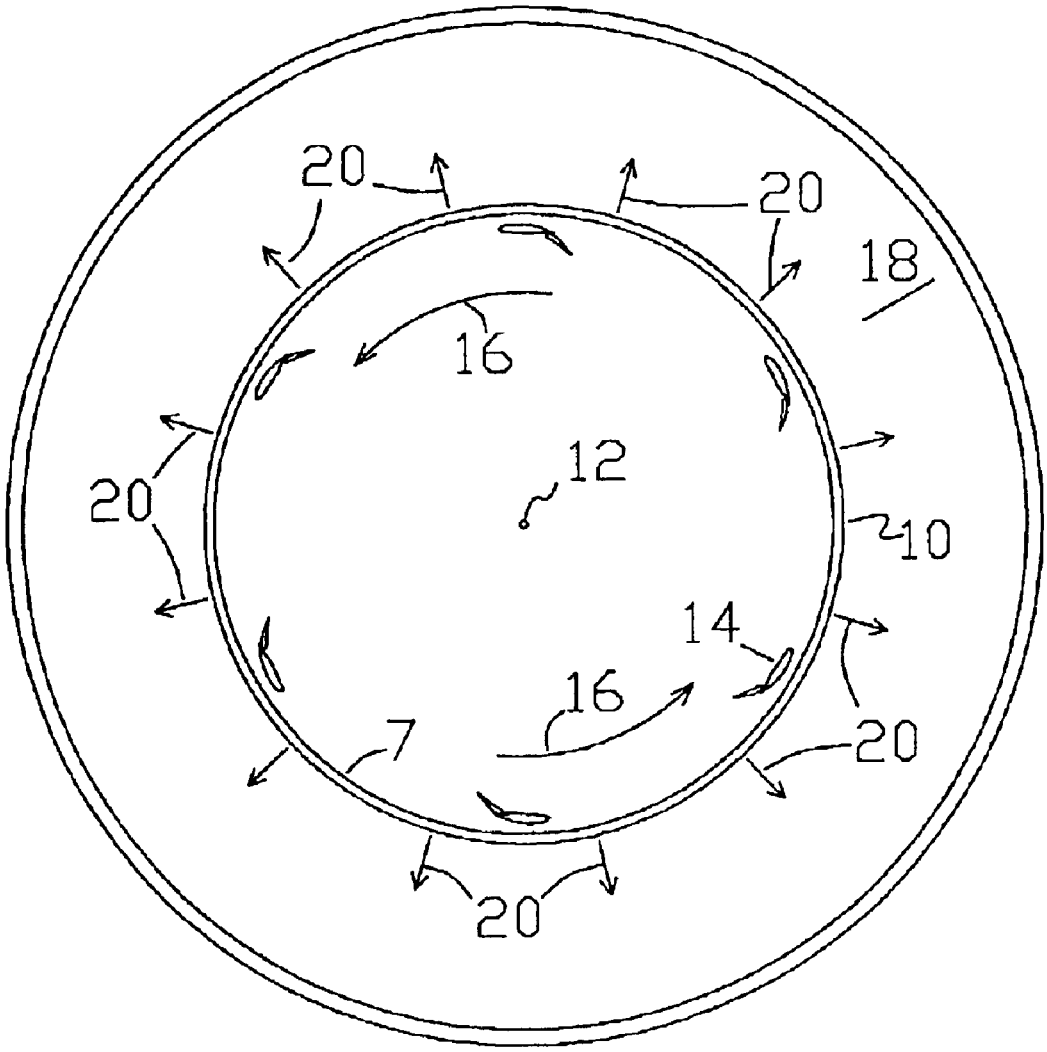
FIG. 1 is a schematic axial view of a pulp screening apparatus incorporation the present invention

FIG. 1 shows a typical right cylindrical pulp screen 10 having a cylindrical axis represented by the point 12. A rotor is represented in Figure by a plurality of foils 14 that are mounted for rotation around the axis 12 as schematically represented by the arrow 16.

As in conventional operations the pulp to be cleaned in the illustrated arrangement is introduce in side of the screen 10 and the cleaned pulp that passes through the screen 12 as indicated by the arrow 20 is collected in the surrounding chamber 18 and from there directed to the next step in the operation. While the arrows 20 indicate the preferred direction of flow it is known to operate screens with the flow in the opposite direction so that the chamber 16 is the inlet chamber and the screened pulp is collect inside the screen 10. The present invention can be adapted to either type of operation i.e. pulp flow toward or away from the axis 12, however the disclosed embodiment show flow away from the axis 12. One skilled in the art can easily convert to flow in the opposite direction.

The present invention replaces the conventional foils or rotor elements normally employed in such screen rotors with multi-element foils (MEF) 14 of the type that will be disclosed in greater detail here in below. The function of each the foil 14 is to operate in the conventional manner to facilitate the screening operation. As above described one of the principal operations of the foil is to generate a negative pressure pulse at the trailing end of the foil to pull material back through and clean the screen.

Foils also may be shaped to generate a positive pressure adjacent to the leading end of the foil to drive material through the screen. The foil 14 in the illustrated embodiments is configured to generate a pressure pulse adjacent to the leading end of the foil 14.

The use of the MEF 14 of the present invention permits improving the operation of the screen by increasing the magnitude of the pressure pulses, particularly the negative pressure pulse generated at the trailing end of the foil 14.

Figure 2:
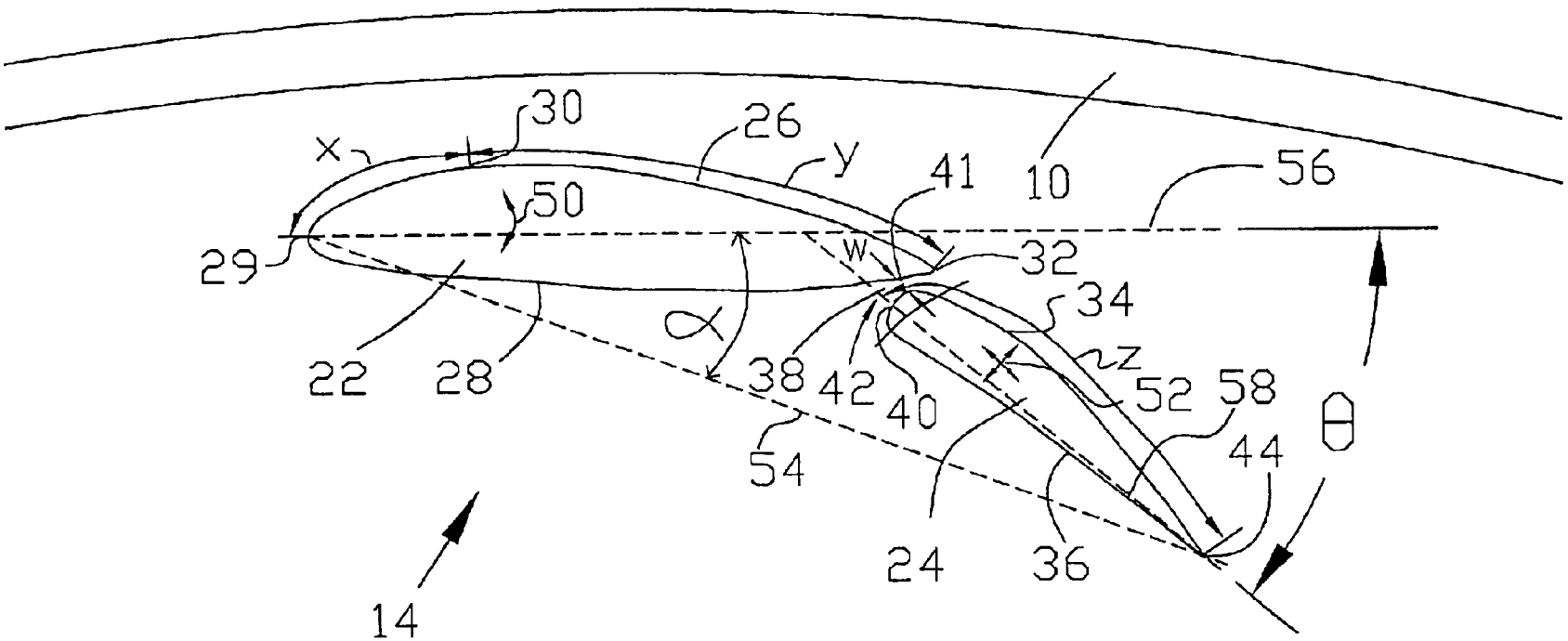
FIG. 2 is a schematic cross section showing a multi element foil (MEF) of the present invention.

The embodiment of the present invention shown in FIG. 2 is a two foil section MEF 14 having a leading foil section 22 leading in a direction of movement of the foil 14 as it is rotated around said cylindrical axis 12 as indicated by the arrows 16 and a trailing foil section 24 trailing the leading section 22 in the direction of movement 16.

The leading foil section 22 has a cambered surface 26 facing toward the screen 10 and an aerodynamic, smooth surface 28 on the side of the section 22 opposite the camber surface 26. The cambered surface 26 trailing the leading end 29 of section 22 is contoured and oriented to approach more closely the screen 10 till the distance between the screen and the surface 26 reaches a selected minimum as indicated at 30 a distance x from the leading end 29 and y from the trailing end 32 of the section 22. The ratio of x/y will normally be in the range of 1 to 10 preferably 1 to 05.

The trailing foil section 24 is formed primarily to generate suction (low) pressure on its cambered (low pressure) surface 34, which faces the screen 10 which aids in producing a higher magnitude (lower pressure) negative pressure pulse at the trailing end 44 of the section 24. A flat or high-pressure (aerodynamic smooth) surface 36 forms the side of the foil section 24 remote from the screen 10.

The cambers or shapes of the surfaces 26 and 34 are each selected based on conventional design practise.

The surface 28 adjacent to the trailing end 32 of foil section 22 is formed with a nesting portion 38 that is positioned between the leading end 40 of the trailing foil section 24 and the screen 10. The portion38 and the leading end 40 are relatively mounted on the rotor (not shown) so that there is a space or passage 42, the opposed walls of which are formed by the adjacent surfaces of the portion 38 and the leading end 40. This passage 42 interconnects and directs fluid flow from the flat or high pressure side 28 of the foil section 22 to the cambered or low pressure side 34 of the trailing foil section 24.

The length z of the cambered surface 34 of foil section 24 measured from the leading end 40 to the trailing end 44 is correlated with the length x+y of the surface 26. The location of the gap or passage 42 between the two foils 22 and 24 (i.e., the relative sizes of the foils) which ends at the trailing end 32 is chosen such that the trailing end 32 is reached before the point of stall for flow along the cambered surface 26 of foil section 22 is reached. The location of stall as is well known is a complex function of foil shape, angle of attack, etc. In practice, the length z of the trailing foil is about ½ to ¼ of the length x+y of the leading foil 22.

It will be apparent that the effective axial length of the foil 14 and thus of the foil sections 22 and 24 extending axially (parallel to the axis 12) will be substantially the full axial length of the screen 10. The most likely configuration would be a series of short axial length foils 14 that extend only ¼ or ⅓ the axial length of the screen. I.e. a plurality of the shorter axial length foils 14 arranged in a staggered configuration that extends the entire axial length of the screen 10. It will be apparent that a full length foil 14 and/or a segmented short axial length foils 14 configuration could be used.

Thus the passage 42 also extends substantially the full axial length of the screen 10 and maintains a substantially uniform spacing between the leading end(s) 40 and the adjacent wall of the portion(s) 38 of the surface(s) 28 of the foil section(s) 22 along substantially the full axial length of the foil 14.

As is apparent from the illustration in FIG. 2 the passage 42 tapers in the direction of flow from the mouth of the passage 42 adjacent to the leading end 40 to the minimum width position 41 where the passage 42 has a minimum width dimension w between surfaces 38 and the adjacent surface 34 of the foil section 24 trailing the leading end 40. This minimum distance w will normally be in the range of 0.1 to 5 cm.

As is known the curvature of the surface 38 is designed so that the fluid flowing along the surface 28 remains in hugging relationship with the surface 38 defining one side of the passage 42 and at or adjacent to the minimum width position 41 flow along the surface 38 transfers to the surface 34 without generating any undue turbulence and combines with and aids in the transfer of the fluid flow leaving the surface 26 so that there is a smooth transition of fluid flow from flow along the surface 26 to flow along the surface 34 as well as flow from the surface 26 (through the passage 42) to the surface 34. In effect both foil sections 22 and 24 are aerodynamic on both the leading 29 and 40 and trailing 32 and 44 edges to eliminate any flow separations at the trailing edge 32 of the first foil The trailing end 44 is aerodynamic (sharp) such that the flows along surfaces 34 and 36 merge together smoothly which reduces the drag on the foil and reduces the power required to rotate the rotor (foil 14). One form of the camber that was found satisfactory is mathematically calculated and is known in the art as a National Advisory Committee for Aeronautics (NACA) shape, more particularly, a NACA 8412 airfoil cut into two airfoils and reshaped.

The leading foil section 22 may be mounted on the rotor (not shown) for angular adjustment relative to a radius leading to the leading end 29 of the section 22 and to be moved radially relative to the axis 12 to be positioned closer or farther from the screen 10 as indicated schematically by the arrow 50. The foil section 24 may be mounted to permit adjustment as indicted by the set of arrows 52. However for a given installation when the optimum positioning has been established the positioning and orientation of the sections 22 and 24 will normally be fixed.

The angle of attack $\alpha$ of the foil 14 which includes the two foil sections 22 and 24 and the cord 54 from which the angle of attack $\alpha$ is determined extends from the leading end 29 of section 22 to the trailing end 44 of section 24. I.e. the angle of attack a of the foil 14 is the angle between the direction of relative movement of the foil through the pulp as indicated by the dotted line 56.

The angle of attack $\theta$ of the trailing foil 24 is determined by the angle $\theta$ between the cord 58 joining the leading end 40 and trailing end 44 of the cambered surface 34 and line 56 and is significantly different from the angle $\alpha$.

The angle $\theta$ generally will be significantly larger than the angle $\alpha$ to up to about tripple In some special cases for example where the foil 14 is at zero angle of attack ($\alpha$=0°), the angle of attack $\theta$ of the trailing section 24 may also zero ($\theta$=0°). Thus in some cases $\alpha$ may equal $\theta$ ($\alpha=\theta$).

The first angle of attack $\alpha$ (of the foil 14) will be in the range of 0° to 45° more preferably 5° to 15° and the second angle of attack $\theta$ (of the trailing section 24) will be in the range of 0° to 60°, more preferably 5° to 25°.

In operation fluid flowing along the surface 28 of the leading foil section 22 follows the surface of the trailing portion 38 through the space 42 between the surface 38 and the leading end 40 of the foil section 24 and then leaves the surface 38 at about the point 41 and follows the cambered surface 34 of the trailing foil section 24. This flow along the surface 34 stabilizes the flow from the surface 26 as it passes onto and over the surface 34 so that the angle of attack $\theta$ of trailing foil section 24 may be increased significantly beyond what could normally be achieve with a conventional single element foil. To insure that the flow of fluid flows smoothly from the surface 28 into the space or passage 42 the geometry of the portion 38 of surface 28 must be aerodynamic to avoid flow separation and to reduce drag that causes undue power consumption. The surface 38 may also be designed to conform to the shape of the leading surface at the leading end 40 of foil 24 such that the both foil sections 22 and 24 together act as a single aerodynamic foil as will be described below with reference to FIG. 3.

Figure 3:
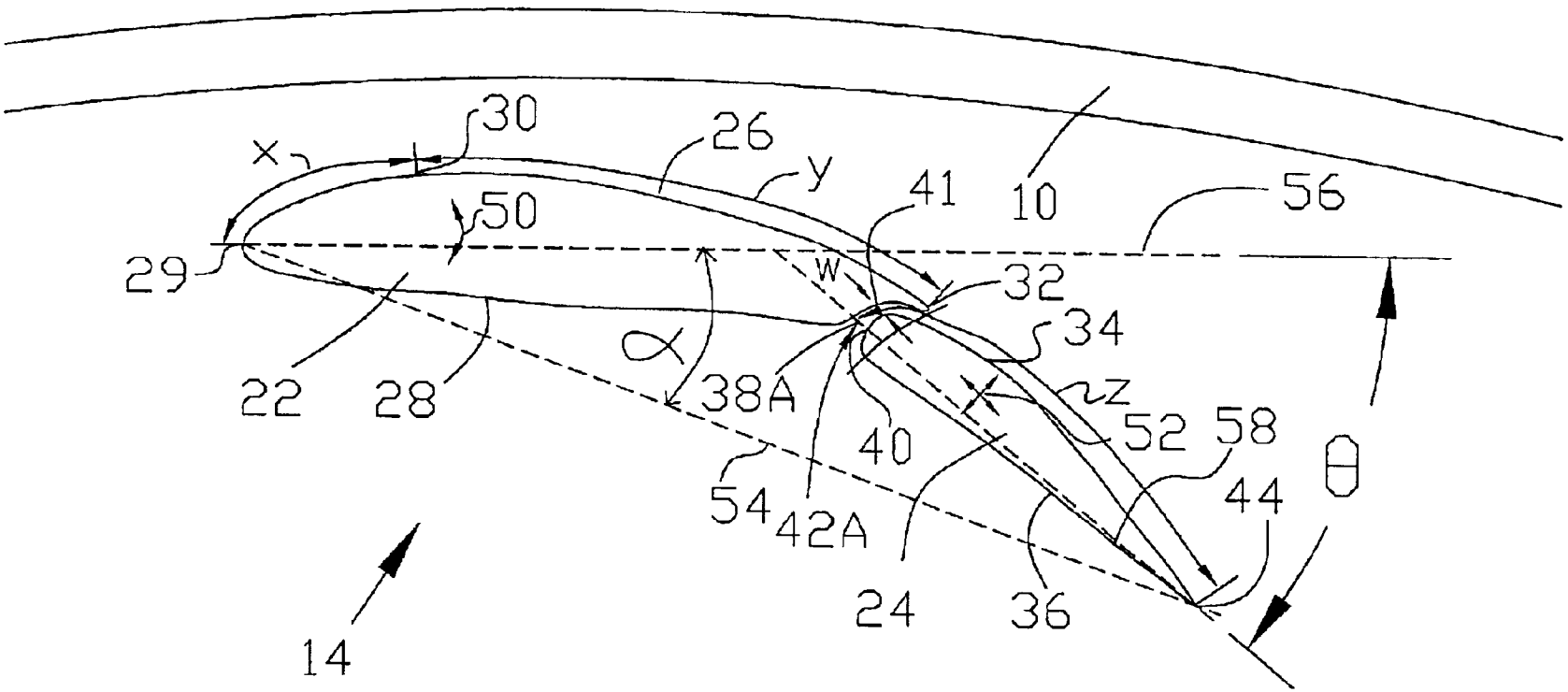
FIG. 3 is a section similar to FIG. 2 but showing a leading foil section with an aerodynamically shaped cavity into which the leading end of the trailing foil section is received.

In FIG. 2 the shape of the surfaces 26 and 28 foil section 22 adjacent to its trailing end 32 and the shape of tehsurface 34 adjacent to the leading end of the airfoil section 24 are aerodynamic which enables the flow to readily pass between the two foils. In FIG. 3, the passage 42A is more tortuous as the portion 38 is converted to a cavity shaped aerodynamic configuration which makes it more difficult for fluid to follow the surface portion 38A and pass through the passage 42A but has the advantage that the entire airfoil 14 is more aerodynamic and has a small drag.

As indicated, the portion 38A as illustrated in FIG. 3 and extending from or forming the trailing end of the pressure surface 28 of the leading foil 22 has been change from what is shown in FIG. 2 so that the cavity defined by the portion 38A is adapted to receive the leading end of the trailing foil 24 with the leading end 40 and adjacent portion of the surface 34 forming one wall of the passage 42 and the surface 38A forming the opposed surface of the passage 42A in the same manner as the surfaces 38 and 34 form opposed walls of the passage 42 in the FIG. 2 embodiment.

The invention has been described with the foil 14 composed of two foil sections 22 and 24, but it is believed that more sections in series could be used if desired in the same manner as such multiple section foils are used in the aircraft industry.

Having described the invention, modifications will be evident to those skilled in the art without departing from the scope of the invention as defined in the appended claims.

We claim:

1. A pulp screening apparatus comprising a substantially cylindrical screen having a cylindrical axis, a foil, means for mounting said foil for rotation on said cylindrical axis, said foil having a leading foil section and a trailing foil section, said leading foil section leading in a direction of movement of said foil as it is rotated around said cylindrical axis and said trailing section spaced from and trailing said leading section in said direction of movement to provide a space separating said a trailing end of said leading foil section and a leading end of said trailing foil section and defining a passage for fluid, each of said foil sections having a high pressure side facing away from said screen and a cambered low pressure side facing and positioned adjacent to said screen, said pressure surface of said leading foil section adjacent to said trailing end of said leading foil section having a portion adjacent to which said leading end of said trailing foil section is positioned so that a surface of said portion of said pressure face on said leading foil section and an adjacent surface of said leading end of said trailing foil section define opposite walls of said passage, said high pressure side of said leading foil section, said opposite walls of said passage and said cambered low pressure side of said trailing foil section being relatively positioned so that fluid passing across said high pressure side of said leading foil section passes through said passage and along said cambered low pressure side of said trailing section, said foil being set at a first angle of attack ($\alpha$) and said trailing foil section being set a second angle of attack ($\theta$).

2. A pulp screening apparatus as defined in claim 1 wherein said first ($\alpha$) and second ($\theta$) angles of attack are different.

3. A pulp screening apparatus as defined in claim 2 wherein said second angle of attack ($\theta$) is larger than said first angle of attack ($\alpha$).

4. A pulp screening apparatus as defined in claim 1 wherein said first angle of attack ($\alpha$) is in the range of 0° to 45° and said second angle of attack ($\theta$) is in the range of 0° to 60°.

5. A pulp screening apparatus as defined in claim 1 wherein said first angle of attack ($\alpha$) is in the range of 5° to 15° and said second angle of attack ($\theta$) is in the range of 5° to 25°.

6. A pulp screening apparatus as defined in claim 1 wherein said passage has a substantially uniform width measured parallel to said axis said width tapering from its mouth at the intersection of high pressure surface of said leading foil section with said portion and minimum width (w) between opposite surfaces.

7. A pulp screening apparatus as defined in claim 6 wherein said minimum width (w) is in the range of 0.1 to 5 centimeters (cm.).

8. A pulp screening apparatus as defined in claim 6 wherein said minimum width (w) is in the range of 0.5 to 2.0 centimeters (cm.).

9. A pulp screening apparatus as defined in claim 4 wherein said passage has a substantially uniform width measured parallel to said axis said width tapering from its mouth at the intersection of high pressure surface of said leading foil section with said cavity and minimum width (w) between opposite surfaces.

10. A pulp screening apparatus as defined in claim 9 wherein said minimum width (w) is in the range of 0.1 to 5.0 centimeters (cm.).

11. A pulp screening apparatus as defined in claim 9 wherein said minimum width (w) is in the range of 0.5 to 2.0 centimeters (cm.).

12. A pulp screening apparatus as defined in claim 1 wherein said leading foil section has a first length (x+y) measured along its cambered surface and said trailing foil section has a second length (z) measured along its cambered surface and the ratio of said first length to said second length will be in the range of 0.5 to 10.

13. A pulp screening apparatus as defined in claim 1 wherein said leading foil section has a first length (x+y) measured along its cambered surface and said trailing foil section has a second length (z) measured along its cambered surface and the ratio of said first length to said second length is in the range of 1 to 4.

14. A pulp screening apparatus as defined in claim 1 wherein said portion comprise a nesting cavity formed in said leading foil and said leading end of said trailing foil is received in said nesting cavity.

15. A pulp screening apparatus as defined in claim 2 wherein said portion comprise a nesting cavity formed in said leading foil and said leading end of said trailing foil is received in said nesting cavity.

16. A pulp screening apparatus as defined in claim 3 wherein said portion comprise a nesting cavity formed in said leading foil and said leading end of said trailing foil is received in said nesting cavity.

17. A pulp screening apparatus as defined in claim 4 wherein said portion comprise a nesting cavity formed in said leading foil and said leading end of said trailing foil is received in said nesting cavity.

18. A pulp screening apparatus as defined in claim 5 wherein said portion comprise a nesting cavity formed in said leading foil and said leading end of said trailing foil is received in said nesting cavity.

19. A pulp screening apparatus as defined in claim 6 wherein said portion comprise a nesting cavity formed in said leading foil and said leading end of said trailing foil is received in said nesting cavity.

20. A pulp screening apparatus as defined in claim 7 wherein said portion comprise a nesting cavity formed in said leading foil and said leading end of said trailing foil is received in said nesting cavity.

* * * * *